US005663702A

United States Patent [19]

Shaw, Jr. et al.

[11] Patent Number: 5,663,702

[45] Date of Patent: Sep. 2, 1997

[54] PTC ELECTRICAL DEVICE HAVING FUSE LINK IN SERIES AND METALLIZED CERAMIC ELECTRODES

[75] Inventors: Philip C. Shaw, Jr., Elk Grove Village; Paul Charles Stein, Schaumburg, both of Ill.

[73] Assignee: Littelfuse, Inc., Des. Plaines, Ill.

[21] Appl. No.: 476,094

[22] Filed: Jun. 7, 1995

[51] Int. Cl.[6] ..... H01H 85/02; H01C 7/13

[52] U.S. Cl. ..... 337/183; 337/142; 337/184; 338/22 R

[58] Field of Search ..... 337/102, 107, 337/140, 232, 401–405, 142, 182, 183, 184; 338/22 R

[56] References Cited

U.S. PATENT DOCUMENTS

| | | | |
|---|---|---|---|
| 3,243,753 | 3/1966 | Kohler | 338/31 |
| 3,351,882 | 11/1967 | Kohler et al. . | |
| 3,828,332 | 8/1974 | Rekai | 340/227 R |
| 4,169,816 | 10/1979 | Tsien | 252/511 |
| 4,177,376 | 12/1979 | Horsma et al. | 219/553 |
| 4,177,446 | 12/1979 | Diaz | 338/212 |
| 4,223,209 | 9/1980 | Diaz | 219/549 |
| 4,237,441 | 12/1980 | van Konynenburg et al. | 338/22 |
| 4,238,812 | 12/1980 | Middleman et al. | 361/106 |
| 4,259,657 | 3/1981 | Ishikawa et al. | 338/22 R |
| 4,272,471 | 6/1981 | Walker | 264/104 |
| 4,318,220 | 3/1982 | Diaz | 29/611 |
| 4,327,351 | 4/1982 | Walker | 338/22 R |
| 4,329,726 | 5/1982 | Middleman et al. | 361/58 |
| 4,330,703 | 5/1982 | Horsma et al. | 219/553 |
| 4,330,704 | 5/1982 | Jensen | 219/553 |
| 4,426,633 | 1/1984 | Taylor | 338/25 |
| 4,445,026 | 4/1984 | Walker | 219/553 |
| 4,481,498 | 11/1984 | McTavish et al. | 338/20 |
| 4,540,969 | 9/1985 | Sugar | 337/232 |
| 4,548,740 | 10/1985 | von Tomkewitsch et al. | 252/511 |
| 4,685,025 | 8/1987 | Carlomagno | 361/106 |

(List continued on next page.)

FOREIGN PATENT DOCUMENTS

| | | |
|---|---|---|
| 1254323 | 5/1989 | Canada . |
| 0 169 059 A2 | 1/1986 | European Pat. Off. . |
| 0 588 136 A2 | 3/1994 | European Pat. Off. . |
| 58-81264 | 5/1983 | Japan . |
| 58-81265 | 5/1983 | Japan . |
| 58-162877 | 10/1983 | Japan . |
| 58-162878 | 10/1983 | Japan . |

(List continued on next page.)

OTHER PUBLICATIONS

Meyer, J., *Polymer Engineering and Science,* Glass Transition Temperature as a Guide to Selection of Polymers Suitable for PTC Materials, Nov., 1973, vol. 13, No. 6, pp. 462–468.

Meyer, J., *Polymer Engineering and Science,* Stability of Polymer Composites as Positive–Temperature–Coefficient Resistors, Oct., 1974, vol. 14, No. 10, pp. 706–716.

V.A. Ettel, P. Kalal, Inco Specialty Powder Products, Advances in Pasted Positive Electrode, (J. Roy Gordon Research laboratory, Mississauga, Ont.), Presented at NiCad 94, Geneva, Switzerland, Sep. 19–23, 1994.

English Translation of Japanese Utility Model Application for Daito Electric dated Jan. 27, 1977, Article 29, item 1, Patent Law Article 30, Item 1, Overcurrent Protective Element.

*Primary Examiner*—Michael W. Phillips
*Assistant Examiner*—Jayprakash N. Gandhi
*Attorney, Agent, or Firm*—Wallenstein & Wagner, Ltd.

[57] ABSTRACT

Electrical devices with a PTC element including a polymer having conductive particles dispersed therein and at least one metallized ceramic electrode. The devices are made by dispersing conductive particles into a polymer to form a polymer PTC composition. The metallized ceramic electrodes include a ceramic substrate having a conductive layer deposited on its surface. The metallized ceramic electrodes are brought into contact with the PTC element, and heated while applying pressure to form a laminate. The laminate is then diced into a plurality of PTC electrical circuit protection devices.

22 Claims, 2 Drawing Sheets

U.S. PATENT DOCUMENTS

| | | | |
|---|---|---|---|
| 4,689,475 | 8/1987 | Kleiner et al. | 219/553 |
| 4,732,701 | 3/1988 | Nishii et al. | 252/511 |
| 4,749,623 | 6/1988 | Endo et al. | 428/551 |
| 4,780,598 | 10/1988 | Fahey et al. | 219/511 |
| 4,800,253 | 1/1989 | Kleiner et al. | 219/553 |
| 4,801,785 | 1/1989 | Chan et al. | 219/549 |
| 4,876,439 | 10/1989 | Nagahori | 219/541 |
| 4,878,038 | 10/1989 | Tsai | 337/107 |
| 4,882,466 | 11/1989 | Friel | 219/219 |
| 4,959,632 | 9/1990 | Uchida | 338/22 |
| 4,966,729 | 10/1990 | Carmona et al. | 252/511 |
| 4,971,726 | 11/1990 | Maeno et al. | 252/511 |
| 4,973,934 | 11/1990 | Saito et al. | 338/22 R |
| 5,064,997 | 11/1991 | Fang et al. | 219/505 |
| 5,068,061 | 11/1991 | Knobel et al. | 252/511 |
| 5,089,688 | 2/1992 | Fang et al. | 219/505 |
| 5,089,801 | 2/1992 | Chan et al. | 338/22 R |
| 5,136,365 | 8/1992 | Pennisi et al. | 357/72 |
| 5,142,263 | 8/1992 | Childers et al. | 338/21 |
| 5,143,649 | 9/1992 | Blackledge et al. | 252/511 |
| 5,148,005 | 9/1992 | Fang et al. | 219/505 |
| 5,174,924 | 12/1992 | Yamada et al. | 252/511 |
| 5,212,466 | 5/1993 | Yamada et al. | 338/22 R |
| 5,214,091 | 5/1993 | Tanaka et al. | 524/425 |
| 5,231,371 | 7/1993 | Kobayashi | 338/22 R |
| 5,247,276 | 9/1993 | Yamazaki | 338/22 R |
| 5,247,277 | 9/1993 | Fang et al. | 338/22 R |
| 5,250,228 | 10/1993 | Baigrie et al. | 252/511 |
| 5,257,003 | 10/1993 | Mahoney | 338/22 R |
| 5,268,665 | 12/1993 | Iwao | 338/22 R |
| 5,281,845 | 1/1994 | Wang et al. | 257/467 |
| 5,289,155 | 2/1994 | Okumura et al. | 338/22 SD |
| 5,313,184 | 5/1994 | Greuter et al. | 338/21 |
| 5,337,038 | 8/1994 | Taniguchi et al. | 338/22 R |
| 5,351,026 | 9/1994 | Kanbara et al. | 338/22 R |
| 5,358,793 | 10/1994 | Hanada et al. | 428/560 |
| 5,382,384 | 1/1995 | Baigrie et al. | 252/511 |
| 5,382,938 | 1/1995 | Hansson et al. | 338/22 R |
| 5,399,295 | 3/1995 | Gamble et al. | 252/511 |

FOREIGN PATENT DOCUMENTS

| | | |
|---|---|---|
| 60-298148 | 12/1985 | Japan . |
| 62-79418 | 5/1987 | Japan . |
| 62-79419 | 5/1987 | Japan . |
| 63-85864 | 4/1988 | Japan . |
| 1-104334 | 4/1989 | Japan . |
| 2-109226 | 4/1990 | Japan . |
| 3-221613 | 9/1991 | Japan . |
| 3-271330 | 10/1991 | Japan . |
| WO 93/14511 | 7/1993 | WIPO . |

PTC ELECTRICAL DEVICE HAVING FUSE LINK IN SERIES AND METALLIZED CERAMIC ELECTRODES

TECHNICAL FIELD

The present invention relates to polymer PTC electrical devices, particularly to the use of ceramic electrodes in polymer PTC electrical devices and methods for producing them.

BACKGROUND OF THE INVENTION

It is well known that the resistivity of many conductive materials change with temperature. Resistivity of a positive temperature coefficient (PTC) conductive material increases as the temperature of the material increases. Many crystalline polymers, made electrically conductive by dispersing conductive fillers therein, exhibit this PTC effect. These polymers generally include polyolefins such as polyethylene, polypropylene and ethylene/propylene copolymers. At temperatures below a certain value, i.e., the critical or trip temperature, the polymer exhibits a relatively low, constant resistivity. However, as the temperature of the polymer increases beyond this point, the resistivity of the polymer sharply increases. Devices exhibiting PTC behavior have been used as overcurrent protection in electrical circuits comprising a power source and additional electrical components in series. Under normal operating conditions in the electrical circuit, the resistance of the load and the PTC device is such that relatively little current flows through the PTC device. Thus, the temperature of the device (due to $I^2R$ heating) remains below the critical or trip temperature. If the load is short circuited or the circuit experiences a power surge, the current flowing through the PTC device increases and its temperature (due to $I^2R$ heating) rises rapidly to its critical temperature. As a result, the resistance of the PTC device greatly increases. At this point, a great deal of power is dissipated in the PTC device. This power dissipation only occurs for a short period of time (fraction of a second), however, because the power dissipation will raise the temperature of the PTC device to a value where the resistance of the PTC device has become so high, that the original current is limited to a negligible value. This new current value is enough to maintain the PTC device at a new, high temperature/high resistance equilibrium point. This negligible or trickle through current value will not damage the electrical components which are connected in series with the PTC device. Thus, the PTC device acts as a form of a fuse, reducing the current flow through the short circuit load to a safe, low value when the PTC device is heated to the critical temperature range. Upon interrupting the current in the circuit, or removing the condition responsible for the short circuit (or power surge), the PTC device will cool down below its critical temperature to its normal operating, low resistance state. The effect is a resettable, electrical circuit protection device.

Polymer PTC electrical circuit protection devices are well known in the industry. Conventional polymer PTC electrical devices include a PTC element interposed between a pair of electrodes. The electrodes can be connected to a source of power, thus, causing electrical current to flow through the PTC element. The PTC element generally comprises a particulate conductive filler which is dispersed in an organic polymer. Materials previously used for electrodes include wire mesh or screen, solid and stranded wires, smooth and microrough metal foils, perforated metal sheets, expanded metal, and porous metals.

For example, U.S. Pat. No. 3,351,882 (Kohler et al.) discloses a resistive element composed of a polymer having conductive particles dispersed therein and electrodes of meshed construction embedded in the polymer. The mesh constructed electrodes disclosed in Kohler et al. are in the form of spaced-apart small wires, wire mesh or wire screening, and a perforated sheet of metal. Generally, electrodes of this type result in a PTC device with a high initial resistance even when the resistivity of the conductive polymer is low. In addition, the use of mesh electrodes with polymer PTC devices are susceptible to the formation of electrical stress concentrations, i.e., hot-spots, which can lead to subpar electrical performance, or even failure of the device. Moreover, conductive terminals which in turn are connected to a power source causing current to flow through the device are difficult to connect to mesh electrodes such as those disclosed in Kohler et al. Japanese Kokai No. 5-109502 discloses an electrical circuit protection device comprising a polymer PTC element and electrodes of a porous metal material. However, electrodes of this type also present difficulties when connecting conductive terminals to the porous electrodes, resulting in initially high resistant devices. U.S. Pat. Nos. 4,800,253 and 4,689,475 disclose electrical devices comprising one or more metal foil electrodes having a roughened surface which contacts a conductive polymer exhibiting PTC behavior. However, electrodes of this type restrict the type and structure of the housing or pakaging which the device may be used in.

The present invention solves these and other problems.

SUMMARY OF THE INVENTION

The present invention is an electrical device comprising a resistive element composed of a PTC composition, and at least one metallized ceramic electrode. The term "ceramic" as used herein is defined as any inorganic, non-metallic, material. The use of a metallized ceramic electrode provides an electrical device having excellent electrical properties with greatly improved physical properties.

Thus, in one aspect the present invention provides an electrical device comprising:

- a PTC element including a polymer with electrically conductive particles dispersed therein, the PTC element having first and second opposed
  surfaces and a resistivity at 25° C. of less than 5 ohm cm;
- a pair of metallized ceramic electrodes, each electrode having an inner surface and an outer surface;
- the inner surface of each electrode in electrical contact with the first and second opposed surfaces of the PTC element;
- the outer surface of each electrode being connectable to a source of electrical power, and when at least one electrode is so connected, causing current to flow through the PTC element; and,
- the electrical device having an electrical resistance at 25° C. of less than 1 ohm.

In another aspect, the present invention provides an electrical device comprising:

- a PTC element composed of a polymer having electrically conductive particles dispersed therein;
- at least one metallized ceramic electrode; and,
- a fuse link electrically connected in series with said PTC element.

In yet another aspect, the present invention provides an electrical fuse assembly comprising:

- a laminar substrate having an upper surface and a lower surface, each surface having a first and second end portion separated by a middle portion;

first and second conductive terminal pads deposited on the lower surface at opposed end portions of the substrate;

a first conductive layer deposited on the first end portion of the upper surface of the substrate and in electrical contact with the first conductive terminal pad;

a second conductive layer deposited on the second end portion of the upper surface of the substrate and in electrical contact with the second conductive terminal pad;

the first conductive layer in electrical contact with, but not in physical contact with, the second conductive layer; and, a PTC element composed of a polymer having electrically conductive particles dispersed therein, the PTC element in electrical contact with the first and second conductive layers.

In another aspect, the present invention provides an electrical fuse assembly including a plurality of electrical circuit protection devices which can be used to protect a number of electrical circuits, the fuse assembly comprising:

a first and second substrate, each substrate having an inner surface and an outer surface;

a plurality of conductive terminal pads deposited on the outer surfaces of the first and second substrates;

a plurality of fuse links deposited on the outer surface of the first substrate;

a plurality of first conductive layers deposited on the inner surface of the first substrate;

a plurality of second conductive layers deposited on the inner surface of the second substrate;

a plurality of PTC elements interposed between the first and second substrates, each PTC element in electrical contact with a single first conductive layer and a single second conductive layer, each PTC element also electrically connected in series with a single fuse link; and, the PTC elements electrically insulated from one another by a plurality of dividing substrates.

In its final aspect, the present invention provides a method for manufacturing an electrical device comprising the following steps:

(a) metallizing a first and a second ceramic substrate, each substrate having an inner surface and an outer surface;

(b) interposing a PTC element between the inner surfaces of the first and second metallized ceramic substrates to form a metallized ceramic substrate, PTC element, metallized ceramic substrate sandwich;

(c) applying heat and pressure to the sandwich from step (b) to form a single laminated structure; and, (d) forming the single laminated structure from step (c) into a plurality of electrical devices.

Other advantages and aspects of the present invention will become apparent upon reading the following description of the drawings and detailed description of the invention.

BRIEF DESCRIPTION OF THE INVENTION

DETAILED DESCRIPTION

Figure 1:
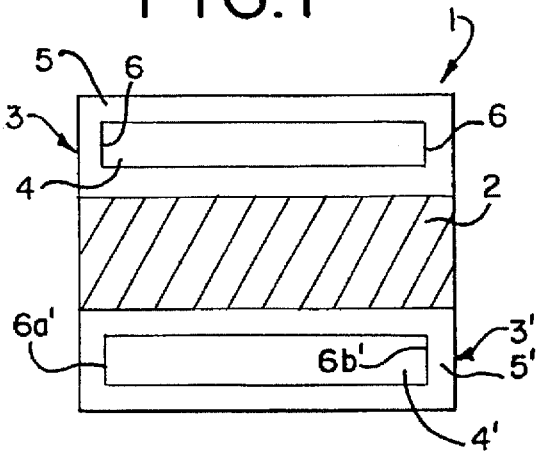
FIG. 1 is a side view of a first embodiment of an electrical device according to the present invention.
Figure 2:
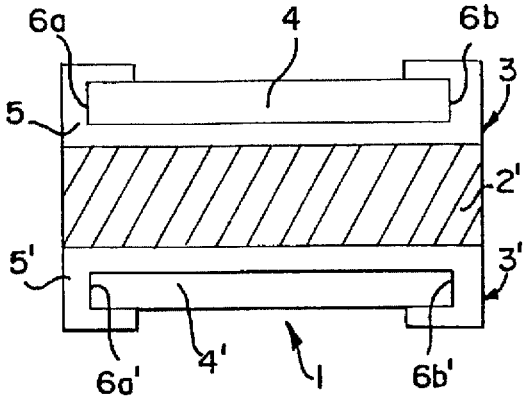
FIG. 2 is a side view of a second embodiment of an electrical device according to the present invention.

FIGS. 1 and 2 illustrate a preferred form of the electrical device 1 of the present invention, including a resistive element 2, and at least one metallized ceramic electrode 3. The resistive element 2 is composed of a PTC composition, preferably a conductive polymer. The metallized ceramic electrodes 3–3' include ceramic substrates 4–4' having conductive layers 5–5' deposited on their surface. Conductive layers 5–5' may completely cover the ceramic substrates 4–4', as illustrated in FIG. 1, or the conductive layers 5–5' may only cover a portion of the top surface of the ceramic substrates 4–4', as illustrated in FIG. 2. In either embodiment, it is important that the conductive layers 5–5' wrap around the side walls *6a–6a'* and *6b–6b'* of each ceramic substrate 4–4', so that when one of the metallized ceramic electrodes 3–3' is connected to a source of electrical power, current can flow from one metallized ceramic electrode 3, through resistive element 2, to the second metallized ceramic electrode 3'.

The metallized ceramic electrodes 3–3' generally comprise ceramic substrates 4–4' made conductive by conductive layers 5–5' which are deposited on the surface of the substrates 4–4'. As previously mentioned, the term "ceramic" as used herein is defined as any inorganic, nonmetallic, material. However, in preferred embodiments, ceramic substrates 4–4' may be comprised of a material selected from the group consisting of alumina, silica, beryllia, and aluminum nitride. Ceramic substrates 4–4' may also be composed of a two component mixture of glass and ceramic such as the machinable glass ceramic sold by Corning under the tradename MACOR®. Conductive layers 5–5' may be deposited on the surface of the ceramic substrates 4–4' by any commonly known ceramic metallization technique, including: electrolytic and electroless plating; vacuum, flash, and electron beam evaporation; plasma sputtering; vapor deposition; screen printing or brazing an organic medium; flame spraying a metallic powder; brushing, rolling, dipping, or spinning an organic medium; and, cladding a foil. These techniques will hereafter be referred to as "commonly known ceramic metallization techniques."

Conductive layers 5–5' can comprise a metal selected from the group consisting of silver, gold, nickel, copper, zinc, platinum, and palladium. Conductive layers 5–5' may also take the form of a conductive thick film ink, a metal foil, or metal particles.

In a preferred embodiment, metallized ceramic electrodes 3–3' comprise a conductive thick film ink, such as QS 175 Silver Conductor manufactured by DuPont Electronics, screen printed on a substrate composed of 96% $Al_2O_3$, such as ADS-96R manufactured by Coors Ceramics. Where the metallized ceramic electrodes 3–3' are in direct contact with the PTC conductive polymer composition which makes up resistive element 2, conductive particles, such as Silver-Coated CNS (silver-coated nickel spheres) manufactured by Novamet Specialty Products, are sprinkled onto the conductive thick film ink to roughen the surface (i.e., increase the surface area) of the metallized ceramic electrodes 3–3' and increase adhesion between the electrodes 3–3' and the resistive element 2.

The PTC conductive polymer of resistive element 2 is preferably a polyolefin. Examples of polyolefins which can be used in the present invention include polyethylene, polypropylene, polybutadiene, polyethylene acrylates, ethylene acrylic acid copolymers, and ethylene propylene copolymers. The polymer is made conductive by dispersing conductive particles therein. The conductive particles can comprise pure metal particles, metal alloy particles, or carbonaceous particles. In a preferred embodiment resistive element 2 is comprised of 65% by volume high density polyethylene and 35% by volume carbon black. This composition exhibits PTC behavior and has an electrical resistivity at 25° C. of less than 10 ohm cm, preferably less than 5 ohm cm, and more preferably less than 1 ohm cm.

The electrical devices of the present invention can be used to protect electrical circuits from both temperature overload and current overload conditions. In low voltage applications (i.e., 40 volts or less) it is desirable that the electrical devices of the present invention have a low electrical resistance at 25° C.. The electrical resistance at 25° C. of the devices of the present invention are less than 1 ohm, preferably less than 0.5 ohm, especially less than 0.1 ohm.

Figure 3:
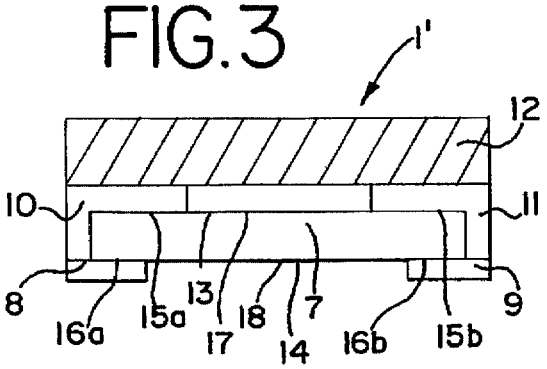
FIG. 3 is a side view of a third embodiment of an electrical device according to the present invention.
Figure 4:
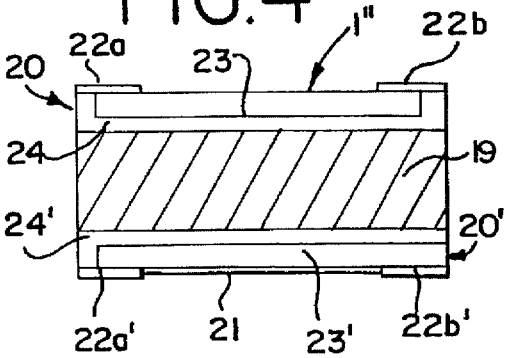
FIG. 4 is a front view of a fourth embodiment of an electrical device according to the present invention.
Figure 5:
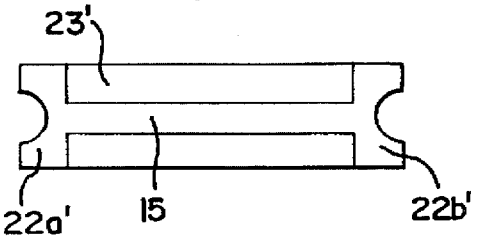
FIG. 5 is a bottom view of the electrical device illustrated in FIG. 4.
Figure 6:
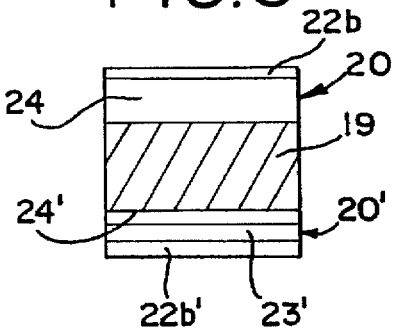
FIG. 6 is a right side view of the electrical device illustrated in FIGS. 4 and 5.
Figure 7:
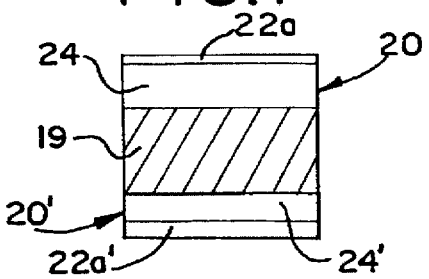
FIG. 7 is a left side view of the electrical device illustrated in FIGS. 4, 5, and 6.
Figure 8:
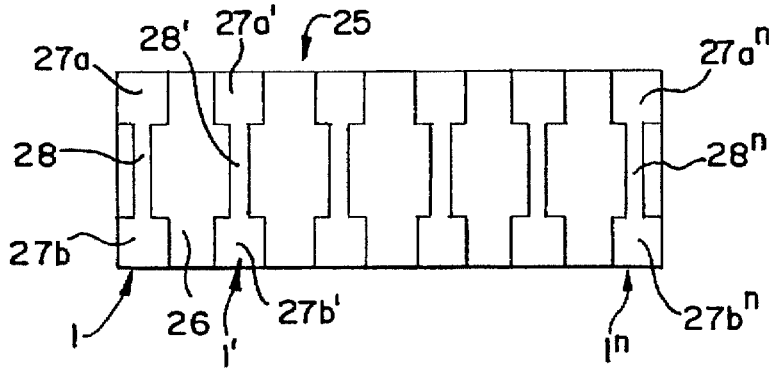
FIG. 8 is a top view of an electrical fuse assembly according to the present invention.
Figure 9:
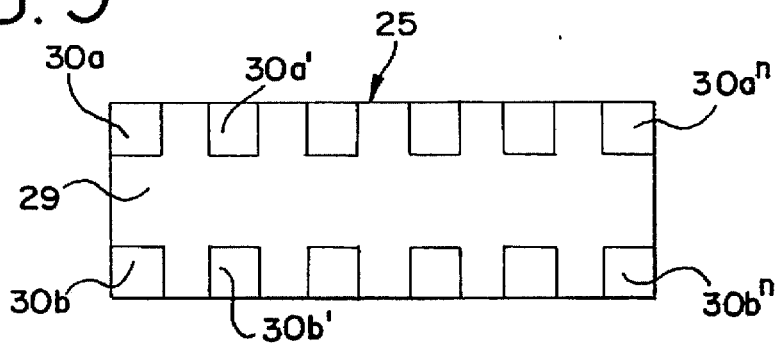
FIG. 9 is a bottom view of the electrical fuse assembly illustrated in FIG. 8.

FIG. 3 illustrates an electrical device 1' of the present invention comprising a laminar ceramic substrate 7, first and second conductive terminal pads 8 and 9, first and second conductive layers 10 and 11, and a PTC element 12. The laminar substrate has an upper surface 13 and a lower surface 14. Each surface has first and second end portions **15*a*–15*b* and 16*a*–16*b* separated by a middle portion 17 and 18. The first and second conductive terminal pads 8 and 9 are deposited on the lower surface 14 at opposed end portions 16*a*–16*b* of the laminar ceramic substrate 7. The first conductive layer 10 is deposited on the first end portion 15*a* of the upper surface 13 of the laminar ceramic substrate 7, and is in electrical contact with the first conductive terminal 8. The second conductive layer 11 is deposited on the second end portion 15*b* of the upper surface 13 of the laminar ceramic substrate 7, and is in electrical contact with the second conductive terminal pad 9. The first conductive layer 10 is in electrical contact, but not physical contact, with the second conductive layer 11. PTC element 12 is composed of a polymer having electrically conductive particles dispersed therein, and is in electrical and physical contact with the first and second conductive layers 10 and 11**.

Laminar ceramic substrate 7 may be comprised of a material selected from the group consisting of alumina, silica, beryllia, and aluminum nitride. Alternatively, laminar ceramic substrate 7 may be comprised of a two component mixture of glass and ceramic.

Conductive terminal pads 8 and 9, and first and second conductive layers 10 and 11 may be deposited on the surface of ceramic laminar substrate 7 by any "commonly known ceramic metallization technique," and may comprise a metal selected from the group consisting of silver, gold, nickel, copper, zinc, platinum, and palladium. First and second conductive layers 10 and 11 preferably comprise the same material, however, the present invention also is intended to cover embodiments where first conductive layer 10 is comprised of a different material than second conductive layer 11. In a preferred embodiment, conductive particles lie between the first conductive layer 10 and the PTC element 12, and also between the second conductive layer 11 and the PTC element 12. The conductive particles roughen the surface of the conductive layers 11 and 12 by increasing the surface area, thereby increasing the adhesion between the PTC element 12 and the conductive layers 10 and 11. The conductive particles comprise a metal selected from the group consisting of silver, nickel, zinc, copper, platinum, palladium, and gold; however, excellent results have been obtained using silver-coated nickel spheres.

PTC element 12 illustrated in FIG. 3 is preferably the same as resistive element 2 illustrated in FIGS. 1 and 2. Accordingly, PTC element 12 generally comprises a polyolefin having conductive particles dispersed therein, and preferably comprises 65% by volume high density polyethylene and 35% by volume carbon black having an electrical resistivity at 25° C. of less than 10 ohm cm, preferably less than 5 ohm cm, especially less than 1 ohm cm.

In the embodiment of the electrical device 1' of the present invention illustrated in FIG. 3, conductive terminal pad 9 can be connected to a source of electrical power. In such case, current flows from conductive terminal pad 9 to second conductive layer 11. Since there is a gap between second conductive layer 11 and first conductive layer 10, current is forced to flow through PTC element 12 to conductive layer 10, and finally to conductive terminal pad 8.

FIGS. 4–7 illustrate an electrical device 1" of the present invention comprising a PTC element 19, at least one metallized ceramic electrode 20–20', and a fuse link 21 electrically connected in series with the PTC element 19. Each metallized ceramic electrode 20–20' has a pair of conductive terminal pads **22*a*–22*b* and 22*a*'–22*b*'. The metallized ceramic electrodes are comprised of a ceramic substrates 23–23' having conductive layers 24–24'** deposited on their surface.

PTC element 19 is composed of a polymer having electrically conductive particles dispersed therein. Preferably, PTC element 19 is comprised of the same material as resistive element 2 in FIGS. 1 and 2. In the same preferred embodiment, metallized ceramic electrodes 20–20' are comprised of a material selected from the group consisting of alumina, beryllia, silica, and aluminum nitride. Metallized ceramic electrodes 20–20' may also be comprised of a two component mixture of glass and ceramic. Conductive layers 24–24', fuse link 21, and conductive terminal pads **22*a*–22*b* and 22*a*'–22*b*' may be comprised of the same material as conductive layers 5–5' in FIGS. 1 and 2, preferably a conductive thick film ink comprising a metal selected from the group consisting of silver, gold, copper, zinc, platinum, and palladium. Conductive layers 24–24', conductive terminal pads 22*a*–22*b* and 22*a*'–22*b*', and fuse link 21 may all be deposited on the surface of the ceramic substrates 23–23'** by any of the "commonly known ceramic metallizing techniques" described in detail above.

In a preferred embodiment, conductive particles lie between the conductive layers 24–24' and the PTC element 19. The conductive particles roughen the surface of the conductive layers 24–24' by increasing the surface area, thus, increasing the adhesion between the PTC element 19 and the conductive layers 24–24'. The conductive particles comprise a metal selected from the group consisting of silver, nickel, zinc, copper, platinum, palladium, and gold;

however, excellent results have been obtained using silver-coated nickel spheres.

In an electrical circuit, conductive terminal pad 22b' of the electrical device 1" illustrated in FIGS. 4–7 can be connected to a source of electrical power. In such case, current will flow from conductive terminal pad 22b', through fuse link 21, to conductive terminal pad 22a'. The current then flows along conductive layer 24', through PTC element 19, to conductive layer 24, and finally to conductive terminal pads 22a–22b. Conductive terminal pads 22a–22b can be electrically connected in series to a plurality of electrical devices which are protected from fault conditions (i.e., thermal overload and current overload) by the electrical device 1" of the present invention.

Referring now to FIGS. 8–11, the present invention provides an electrical fuse assembly 25 which includes a plurality of electrical circuit protection devices, 1, 1', . . . , 1$^n$, which can be used to protect a number of electrical circuits. The electrical fuse assembly 25 comprises a first and second substrate 26 and 29, each substrate having an inner surface and an outer surface. A plurality of conductive terminal pads 27a–27b, 27a'–27b', . . . , 27a$^n$–27b$^n$ and 30a–30b, 30a'–30b', . . . , 30a$^n$–30b$^n$, wherein n is the total number of circuit protection devices contained in the electrical fuse assembly 25, are deposited on the outer surface of the first and second substrates 26 and 29. A plurality of fuse links 28, 28', . . . , 28$^n$ are deposited on the outer surface of the first substrate 26.

Figure 10:
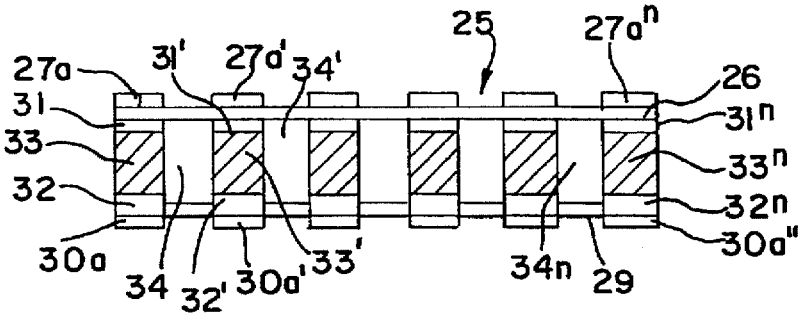
FIG. 10 is a rear view of the electrical fuse assembly illustrated in FIGS. 8 and 9.
Figure 11:
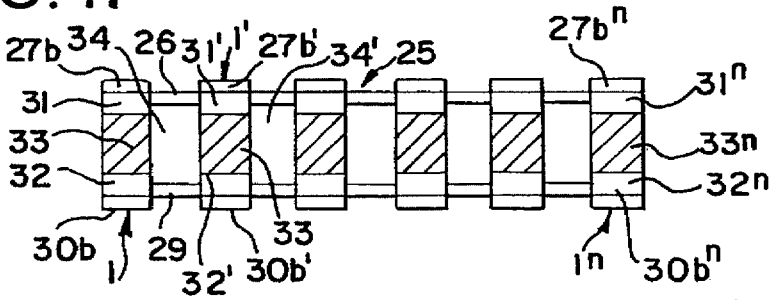
FIG. 11 is a front view of the electrical fuse assembly illustrated in FIGS. 8, 9, and 10.

With reference now to FIGS. 10 and 11, a plurality of first conductive layers 31, 31', . . . , 31$^n$ are deposited on the inner surface of the first substrate 26, while a plurality of second conductive layers 32, 32', . . . , 32$^n$ are deposited on the inner surface of the second substrate 29. A plurality of PTC elements 33, 33', . . . , 33$^n$ are interposed between the first and second substrates 26 and 29. The plurality of PTC elements 33, 33', . . . , 33$^n$ are electrically insulated from one another by a plurality of dividing substrates 34, 34', . . . , 34$^n$.

In a preferred embodiment, first and second substrates 26 and 29 comprise ceramic; especially a material selected from the group consisting essentially of alumina, silica, beryllia, and aluminum nitride. Substrates 26 and 29 may also comprise a mixture of ceramic and glass.

The plurality of conductive terminal pads 27a–27b-27a$^n$-27b$^n$ and 30a–30b-30a$^n$–30b$^n$, plurality of first and second conductive layers 31–31$^n$ and 32–32$^n$, and plurality of fuse links 28–28$^n$ may be comprised of the same materials as conductive terminal pads 22a–22b and 22a'–22b', fuse link 21, and first and second conductive layers 24–24' in the embodiment illustrated in FIGS. 4–7; preferably, a conductive thick film ink comprising a metal selected from the group consisting of silver, gold, copper, zinc, platinum, and palladium. The plurality of conductive terminal pads 27a–27b-27a$^n$–27b$^n$ and 30a–30b-30a$^n$–30b$^n$, plurality of first and second conductive layers 31–31$^n$ and 32–32$^n$, and plurality of fuse links 28–28$^n$ illustrated in FIGS. 8–11 can all be deposited on the surfaces of first and second substrates 26 and 29 using "commonly known ceramic metallization techniques."

In a preferred embodiment, conductive particles lie between the plurality first conductive layers 31–31$^n$ and the plurality PTC elements 33–33$^n$, and also between the plurality of second conductive layers 32–32$^n$ and the plurality of PTC elements 33–33$^n$. The conductive particles roughen the surface (i.e., increase the surface area) of the conductive layers 31–31$^n$ and 32–32$^n$ thereby increasing the adhesion between the plurality of PTC elements 33–33$^n$ and the conductive layers 31–31$^n$ and 32–32$^n$. The conductive particles comprise a metal selected from the group consisting of silver, nickel, zinc, copper, platinum, palladium, and gold; however, excellent results have been obtained using silver-coated nickel spheres.

As is best illustrated in FIGS. 10 and 11, it is important that the plurality of first conductive layers 31–31$^n$ wrap around the side wall of first substrate 26 at one end of the first substrate 26 only, so that first conductive layers 31–31$^n$ are in electrical contact with conductive terminal pads 27b–27b$^n$, but not with conductive terminal pads 27a–27a$^n$. It is also important that the plurality of second conductive layers 32–32$^n$ wrap around the side wall of second substrate 29 at both end portions of the second substrate 29 so that they are in electrical contact with both conductive terminal pads 30a–30a$^n$ and 30b–30b$^n$.

Thus, when conductive terminal pads 27a–27a$^n$ are electrically connected in separate circuits, the current through each circuit protection device 1–1$^n$ of the fuse assembly 25 will flow from conductive terminal pads 27a–27a$^n$, through fuse links 28–28$^n$, to conductive terminal pads 27b–27b$^n$. The current from separate circuits will then flow along the plurality of first conductive layers 31–31$^n$, through the plurality of PTC elements 33–33$^n$, to the plurality of second conductive layers 32–32$^n$, and back to conductive terminal pads 30a–30a$^n$ and 30b–30b$^n$. Accordingly, the fuse assembly 25 of the present invention can be used to protect a plurality of individual circuits.

The present invention is illustrated by the following example.

EXAMPLE

A quantity of high density polyethylene (HDPE) (manufactured by Quantum under the trade name Petrothene) and carbon black (manufactured by Cabot under the trade name BP 160-Beads) was dried by placing it in an oven at 100° C. overnight. A PTC polymer composition was prepared using the polyethylene and carbon black in the amounts listed below in Table 1.

TABLE 1

| | density (gm/cc) | volume (%) | weight (%) | weight (gm) |
|---|---|---|---|---|
| HDPE (Petrothene LB8520-00) | 0.96 | 65 | 49.08 | 117.78 |
| Carbon Black (BP 160-Beads) | 1.85 | 35 | 50.92 | 122.22 |
| Total | 1.2715 | 100 | 100 | 240 |

The polyethylene was placed in a C. W. Brabender Plasti-Corder PL 2000 equipped with a Mixer-Measuring Head and fluxed at 200° C. for approximately 5 minutes at 5 rpm. At this point the polyethylene was in a molten form. The carbon black was then slowly dispersed into the molten polyethylene over a 5 minute period at 200° C. at 5 rpm. The speed of the Brabender mixer was then increased to 80 rpm, and the HDPE and carbon black were thoroughly mixed at 200° C. for 5 minutes. The energy input, due to the mixing, caused the temperature of the composition to increase to 240° C.

After allowing the composition to cool, the composition was then placed into a C. W. Brabender Granu-Grinder where it was ground into small chips. The chips were then fed into the C. W. Brabender Plasti-Corder PL 2000 equipped with an Extruder Measuring Head. The extruder was fitted with a die having an opening of 0.002 inch, and the belt speed of the extruder was set at 2. The temperature of the extruder was set at 200° C., and the screw speed of the extruder was measured at 50 rpm. The chips were extruded into a sheet approximately 2.0 inches wide by 8 feet long. This sheet was then cut into a number of 2 inch×2 inch sample PTC elements, and pre-pressed at 200° C. to a thickness of approximately 0.01 inch.

Two 2 inch×2 inch, 0.025 inch thick 96% $Al_2O_3$ substrates having a plurality of laser punched through holes are screen printed with a conductive thick film ink, available from DuPont Electronics under the tradename QS 175 silver Conductor. The conductive thick film ink is also applied to the inner surface of the laser punched through holes. Both thick film ink coated substrates are dried at 150° C. for approximately 10 minutes. The thick film ink coated substrates are then fired in a temperature controlled oven at 850° C. for approximately 30 minutes.

After the substrates have cooled, the inner surface of each substrate is once again coated (by screen printing) with the conductive thick film ink. While the thick film ink is still wet, silver-coated nickel spheres (available from Novamet Specialty Products under the tradename Silver-Coated CNS) are sprinkled on the thick film ink. The coated substrates are dried at 50° C. for approximately 10 minutes, and then fired in a temperature controlled oven at 850° C. for approximately 30 minutes.

A sample PTC element is then interposed between two metallized ceramic substrates and laminated in a hot press at 230° C. and 400 p.s.i for approximately 5 minutes. The 2 inch×2 inch laminated metallized ceramic, PTC element, metallized was removed from the press, allowed to cool, and diced out into a number of 0.250 inch×0..250 inch devices. The devices are diced through the diameter of the through holes so that electrical connection is maintained across the side walls of the metallized ceramic substrate.

A number of the electrical devices made according the process described above were then tested to determine their initial electrical resistance at 25° C. The results of these tests are indicated in Table 2 below.

TABLE 2

PTC CIRCUIT PROTECTION DEVICES WITH METALLIZED CERAMIC ELECTRODES

| Sample No. | Initial Resistance (ohms) at 25° C. |
|---|---|
| 1 | 0.09603 |
| 2 | 0.13156 |
| 3 | 0.07506 |
| 4 | 0.10237 |
| 5 | 0.11435 |
| 6 | 0.09459 |
| 7 | 0.14418 |
| 8 | 0.12347 |
| 9 | 0.08724 |
| 10 | 0.08336 |
| 11 | 0.13066 |
| 12 | 0.10880 |
| 13 | 0.14003 |
| 14 | 0.12435 |
| 15 | 0.13254 |
| 16 | 0.14660 |
| 17 | 0.15107 |
| 18 | 0.13738 |
| 19 | 0.14281 |
| 20 | 0.17346 |

I claim:

1. An electrical fuse assembly including a plurality of electrical circuit protection devices which can be used to protect a number of electrical circuits, the fuse assembly comprising:

a first and second substrate, each substrate having an inner surface and an outer surface;

a plurality of conductive terminal pads deposited on the outer surfaces of the first and second substrates;

a plurality of fuse links deposited on the outer surface of the first substrate;

a plurality of first conductive layers deposited on the inner surface of the first substrate;

a plurality of second conductive layers deposited on the inner surface of the second substrate;

a plurality of PTC elements interposed between the first and second substrates, each PTC element in electrical contact with a single first conductive layer and a single second conductive layer, each PTC element also electrically connected in series with a single fuse link; and, the PTC elements electrically insulated from one another by a plurality of dividing substrates.

2. An electrical fuse assembly according to claim 1, wherein the first and second substrate comprise ceramic.

3. An electrical fuse assembly according to claim 1, wherein the first and second substrate are comprised of a material selected from the group consisting essentially of alumina, silica, beryllia, and aluminum nitride.

4. An electrical fuse assembly according to claim 1, wherein the first and second substrate are comprised of glass and ceramic.

5. An electrical fuse assembly according to claim 1, wherein the plurality of first and second conductive layers comprise a conductive thick film ink.

6. An electrical fuse assembly according to claim 1, wherein the plurality of first and second conductive layers comprise a metal selected from the group consisting essentially of silver, copper, zinc, nickel, gold, palladium, and platinum.

7. The electrical device of claim 1, wherein the device has an electrical resistance at approximately 25° C. of less than 1 ohm.

8. The electrical device of claim 1, wherein the device has an electrical resistance at approximately 25° C. of less than 0.5 ohm.

9. The electrical device of claim 1, wherein the device has an electrical resistance at approximately 25° C. of less than 0.1 ohm.

10. An electrical device comprising:

a first and second laminar substrate, each laminar substrate having an inner surface and an outer surface;

at least one conductive terminal pad deposited on the outer surface of the first laminar substrate;

at least two conductive terminal pads deposited on the outer surface of the second laminar substrate;

a fuse link electrically connecting the two conductive terminal pads deposited on the second laminar substrate, the entire fuse link being deposited on the outer surface of the second laminar substrate;

first and second conductive layers deposited on the inner surfaces of the first and second laminar substrates, respectively;

the first conductive layer electrically connected to at least one conductive terminal pad deposited on the outer surface of the first laminar substrate and the second conductive layer electrically connected to only one terminal pad deposited on the outer surface of the second laminar substrate; and a PTC element interposed between the first and second substrates and in electrical contact with the first and second conductive layers such that the PTC element is electrically connected in series with the fuse link.

11. The electrical device of claim 10, wherein the first and second laminar substrates comprise ceramic.

12. The electrical device of claim 10, wherein the first and second laminar substrates are comprised of a material selected from the group consisting essentially of alumina, silica, beryllia and aluminum nitride.

13. The electrical device of claim 10, wherein the first and second laminar substrates comprise a glass-ceramic material.

14. The electrical device of claim 10, wherein the first and second conductive layers comprise a polymer thick film ink.

15. The electrical device of claim 10, wherein the first and second conductive layers comprise a metal selected from the group consisting essentially of silver, copper, zinc, nickel, gold, palladium and platinum.

16. An electrical device comprising:

a PTC element composed of a polymer having electrically conductive particles dispersed therein;

at least one metallized ceramic electrode; and, a fuse link electrically connected in series with the PTC element, the entire fuse link deposited on the metallized ceramic electrode.

17. An electrical device according to claim 16, wherein the metallized ceramic electrode has a pair of conductive terminal pads deposited on its surface, the conductive terminal pads electrically connected by the fuse link.

18. An electrical device according to claim 16, wherein the metallized ceramic electrode comprises a ceramic substrate having a conductive layer deposited on its surface.

19. An electrical device according to claim 16, wherein the metallized ceramic electrode comprises a ceramic substrate and a layer of conductive thick film ink.

20. An electrical device according to claim 16, wherein the metallized ceramic electrode comprises a material selected from the group consisting of alumina, silica, beryllia, and aluminum nitride.

21. An electrical device according to claim 16, wherein the metallized ceramic electrode comprises glass and ceramic.

22. An electrical device according to claim 16, wherein the metallized ceramic electrode comprises a ceramic substrate composed of $Al_2O_3$, a layer of conductive thick film ink, and a layer of conductive particles.

* * * * *

UNITED STATES PATENT AND TRADEMARK OFFICE

CERTIFICATE OF CORRECTION

PATENT NO. : 5,663,702
DATED : September 2, 1997
INVENTOR(S) : Philip C. Shaw Jr. and Paul Charles Stein It is certified that error appears in the above-identified patent and that said Letters Patent is hereby corrected as shown below:

Column 2 Line 27 CHANGE "pakaging" to "packaging"

Column 3 Line 59 CHANGE "Invention" to "drawing"

Column 9 Line 24 CHANGE "50°C" to "150°C"

Column 9 Line 31 CHANGE "0..250" TO "0.250"

Column 10 Line 36 CHANGE "claim 1" to "claim 16"

Column 10 Line 39 CHANGE "claim 1" to "claim 16"

Column 10 Line 42 CHANGE "claim 1" to "claim 16"

Signed and Sealed this

Twelfth Day of September, 2000

*Attest:*

Q. TODD DICKINSON

*Attesting Officer*

*Director of Patents and Trademarks*